United States Patent [19]

Roberts

[11] 4,193,962

[45] Mar. 18, 1980

[54] MELT SPINNING PROCESS

[75] Inventor: John S. Roberts, Ellicott City, Md.

[73] Assignee: Kling-Tecs, Inc., Mantoloking, N.J.

[21] Appl. No.: 932,832

[22] Filed: Aug. 11, 1978

[51] Int. Cl.[2] ..... D01D 5/08

[52] U.S. Cl. ..... 264/178 F; 264/180; 425/71

[58] Field of Search ..... 425/71, 68, 69; 264/178 F, 180

[56] References Cited

U.S. PATENT DOCUMENTS

| | | | |
|---|---|---|---|
| 3,664,782 | 5/1972 | Nevin | 264/178 F |
| 3,856,445 | 12/1974 | Norwood | 264/178 F |
| 3,905,381 | 9/1975 | Meger | 264/178 F |
| 3,932,576 | 1/1976 | Patel | 264/178 F |

FOREIGN PATENT DOCUMENTS

| | | | |
|---|---|---|---|
| 43-26326 | 11/1968 | Japan | 264/178 F |
| 48-23806 | 7/1973 | Japan | 264/178 F |

*Primary Examiner*—Jay H. Woo

*Attorney, Agent, or Firm*—Albert C. Nolte, Jr.; Edward B. Hunter

[57] ABSTRACT

Apparatus and method are described for extruding filaments of thermoplastic material, particularly polypropylene, by liquid quench melt spinning in which a baffle arrangement is disposed in the quench liquid around the location where the filaments enter to reduce turbulence, vortexing, and liquid level variation. The baffle arrangement forms an opentopped box-like structure with two quench liquid inlet apertures and one quench liquid outlet aperture. Yarn guides are disposed inside this structure and the filaments, after solidifying, pass around the yarn guides and then upwards, at an angle of about 30 degrees to the horizontal, through the quench liquid outlet aperture. The passage of the filaments creates a pumping action of the quench liquid in through the two inlet apertures and out through the outlet aperture. The area of the outlet aperture is less than the sum of the areas of the inlet apertures, to create an inefficient pump. Wetting agent is introduced through four nozzles at the liquid surface adjacent the back of said structure.

6 Claims, 5 Drawing Figures

FIG. 1
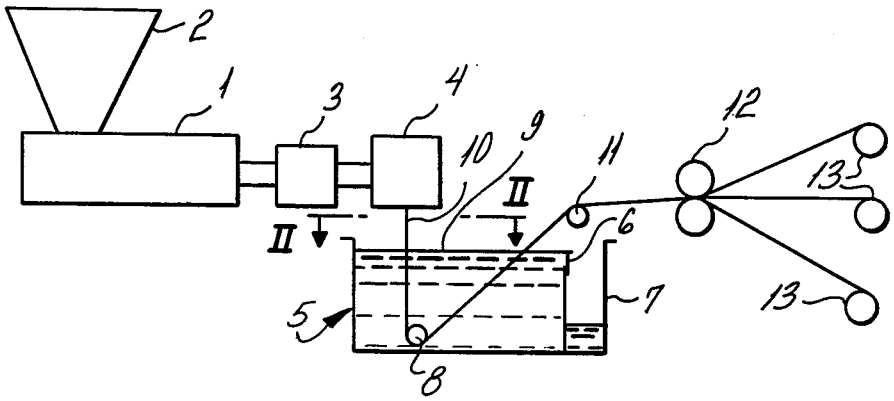
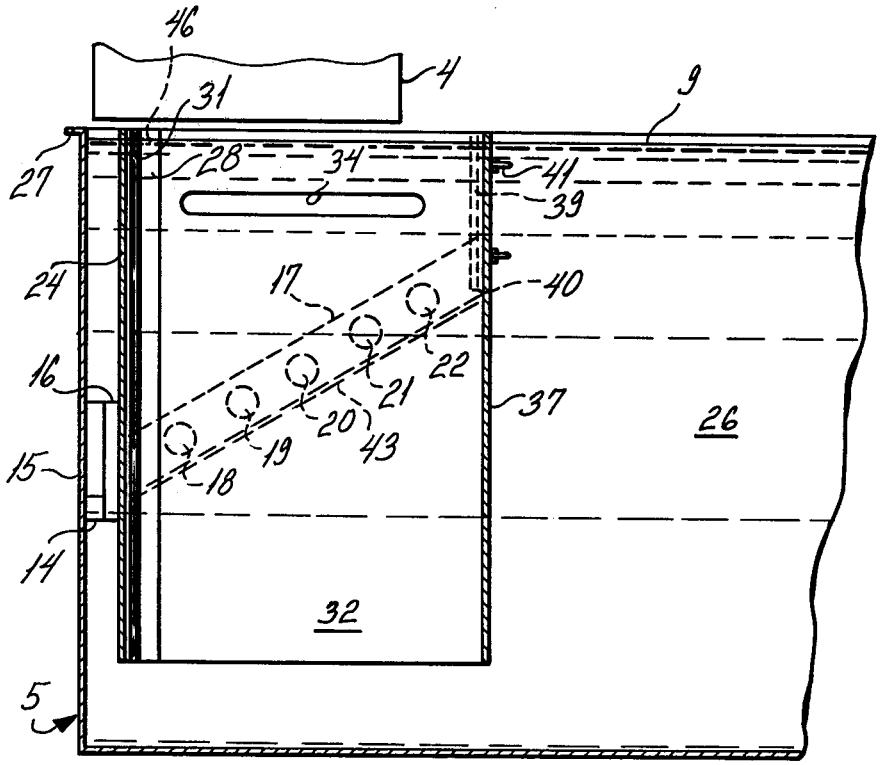
FIG. 4

MELT SPINNING PROCESS

BACKGROUND OF THE INVENTION

Liquid quench, or as it is more commonly called 'water quench', extrusion has in the past traditionally been used for monofilament production, that is for filaments having a denier, after drawing, greater than 50. During the last ten years it has been realized that, with refinements, textile quality multi-filament yarns can be produced by water quench extrusion, that is multi-filament yarns in which the filaments are reasonably uniform and have, for example, a denier per filament of less than 35 after drawing. However, as attempts have been made to increase the rate of extrusion, and/or to decrease the denier of the filaments, problems have arisen.

One of these problems has been increased vortexing in the area where the molten filaments enter the quench water. This causes adjacent filaments to be brought together and, in their molten state, to adhere to each other to create fused filaments. Sometimes the vortexing is severe enough to cause the molten filaments to break, known as spin breaks.

Another of these problems that has arisen is a variation in the level of the quench water in the area where the molten filaments enter in. This may be caused by wave motions in the quench water, or by turbulence, or when extrusion is being started. Again, this may cause fused filaments or spin breaks; also, varying the distance between the spinnerette and the surface of the quench water, this distance being called the 'hot stretch', can adversely vary characteristics of the filaments.

U.S. Pat. No. 3,696,184 describes a baffle, or more commonly called a cage, arrangement which contributes towards reducing at least some of the above problems. A composite cage constituted of three concentric, foraminous, hollow cylinders closely surrounds the area where the molten filaments enter the quench bath. However, it has been stated that as production rates were increased, it was found that a cage which entirely surrounded the area at which the filaments entered the quench water could contribute to vortexing while reducing random turbulence.

U.S. Pat. No. 3,932,576 describes a further improvement to the arrangement in U.S. Pat. No. 3,696,184. The area in which the filaments enter the quench water is only partially surrounded by a half cage and in addition wetting agent is introduced at at least two symmetrical locations about the periphery of that area.

Although this latter arrangement has given satisfactory results, it has been found difficult to obtain steady running conditions when attempting to reduce the filaments to deniers, after drawing, of less than 25. Fused filaments became predominent and occasional spin breaks occurred. Also, separation problems occurred, that is a filament from one group of filaments would be displaced from that group and become included in an adjacent group. These problems became more acute when the number of filaments in a yarn were increased; for example, if instead of making a multifilament yarn having a drawn denier of 520 and 18 filaments, it was attempted to make a yarn having a drawn denier of 520 and 27 filaments. Not only is the denier per filament being reduced from 29 to 19, but also the number of filaments is being increased from 18 to 27.

It is observed that the finer the filaments, the greater is their surface to volume ratio which presumably increases the drag per denier through the quench water. It is also observed that the greater the number of filaments in a yarn, the closer together the filaments are extruded and the more readily they come in contact with each other while still molten.

SUMMARY OF THE INVENTION

The present invention provides a baffle arrangement in the quench tank which enables multifilament yarns having more and finer denier filaments to be produced. The present invention also seeks to increase the production rate of multifilament yarns by water quench extrusion.

The theory upon which the present invention is based is that baffle means, or equivalent structure, should be arranged in relation to the filaments entering and being quenched in the quench tank, so that an inefficient pump is created, that is a pump in which the output is choked, with the movement of the filaments generating the pumping action.

According to one aspect of the invention there is provided in a melt spinning apparatus for extrusion of a plurality of filaments having at least a thermoplastic component, the apparatus comprising a vessel for containing a quench liquid and a spin block arranged above the level to which the vessel is to be filled with quench liquid so that molten filaments when extruded enter the quench liquid wherein the filaments are quenched and solidified, the improvement comprising baffle means separating a portion of the vessel in which the filaments are solidified from the remainder of the vessel with at least part of the bottom of said portion being confined, quench liquid inlet means in said baffle means, and quench liquid outlet means in said baffle means and through which the solidified filaments are arranged to be withdrawn from said portion, the area of said inlet means being greater than the area of said outlet means.

Said inlet means and said outlet means may comprise separate apertures. The apertures are preferably below said level, and the outlet means is preferably below said inlet means.

Said baffle means may have a bottom partition spaced above the bottom of said vessel. The bottom partition may be parallel to the filaments as they are withdrawn through said outlet means. Preferably there is a front partition which may at least partly define said outlet means. The baffle means may have a back partition and two side partitions which may be connected to both the back and front partitions. At least a part of one or more of these partitions may be movable, for example by pivotting, to facilitate separation of the filaments at commencement of spinning.

Yarn guides are preferably disposed inside said baffle means for passage of the filaments therearound after solidifying and before being withdrawn through said outlet means. Preferably, the filaments are withdrawn upwards through said outlet means at an angle of at least 30 degrees to the horizontal.

A plurality of wetting agent nozzles may be arranged to deliver wetting agent at the surface of the quench liquid within said baffle means. Preferably at least some of said nozzles are along or adjacent said back partition.

The invention also provides a method of producing a plurality of multifilament thermoplastic yarns by liquid quench spinning in which the filaments are extruded in the molten state into a liquid quench bath in which they are quenched and solidified before being withdrawn from said quench bath, whereby the molten filaments enter a partitioned portion of the quench bath and cause a pumping action of the quench liquid through said portion, the quench liquid entering said portion through an area greater than that through which the quench liquid exits from said portion.

The filaments may have a denier after drawing of less than 25 and there may be at least 27 filaments in each yarn. However, this method may be used to produce at increased production rates yarns having heavier denier filaments.

A specific embodiment of the invention will now be described in greater detail with reference to the accompanying drawings.

BRIEF DESCRIPTION OF THE DRAWINGS

FIG. 1 is a schemmatic elevational view, partly in section, of a liquid quench melt spinning apparatus known per se;

FIG. 4 is a vertical sectional view on the line IV—IV of part of FIG. 3.

DESCRIPTION OF A SPECIFIC EMBODIMENT

Figure 2:
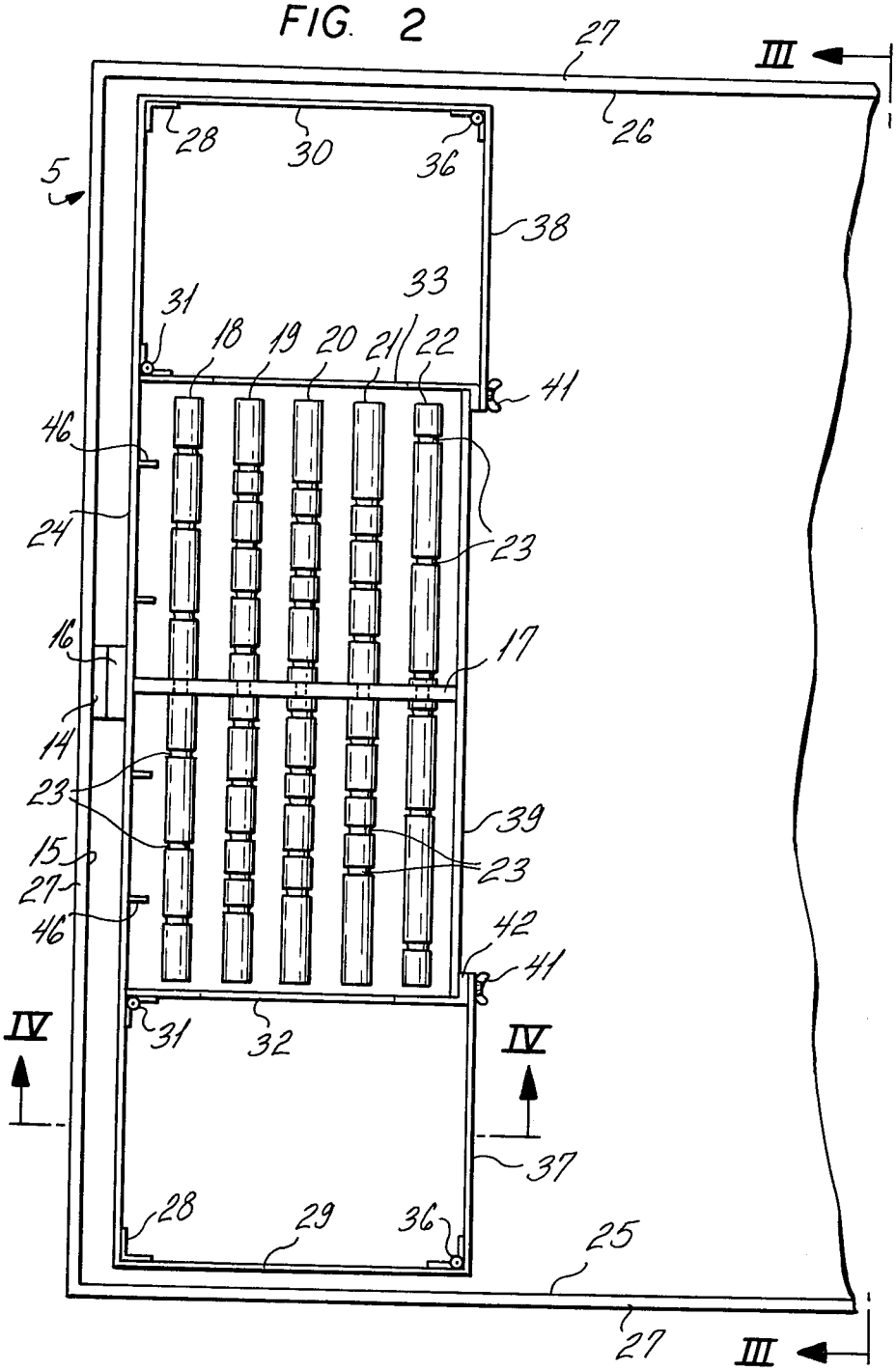
FIG. 2 is a plan view on the line II—II of part of FIG. 1 showing a baffle arrangement according to the invention.

In FIG. 1 an extruder 1 has an infeed hopper 2, a metering pump arrangement 3 and a spin block 4 which supports a pair of spin packs each containing a spinnerette (not shown). Below the spin block 4 is a quench tank 5 having an adjustable overflow weir 6 and drain compartment 7. A guide bar arrangement 8 is disposed in the tank 5. In operation pellets of thermoplastic material, for example polypropylene, which may be mixed with pellets of color concentrate, are fed through the hopper 2 into the extruder 1 where they are melted and mixed. The metering pump arrangement 3 pumps metered streams of the molten thermoplastic to the spin block 4, downwards through the spin packs to the spinnerettes from which issue downwardly a plurality of molten filaments 10. The quench tank 5 is filled to a level 9, determined by the weir 6, with water (containing some additives) in which the molten filaments are quenched and solidifed before they pass around the guide bar arrangement 8 and then exit from the tank 5 over a wiper bar 11. The filaments are withdrawn from the tank 5 by nip rollers 12, and then wound onto a plurality of packages 13. A manner in which the water level 9 may be controlled is more fully described in U.S. Pat. No. 3,932,576. The function and a specific example of the guide bar arrangement 8 in the production of a plurality of multifilament yarns is more fully described in U.S. Pat. No. 3,856,445.

Figure 3:
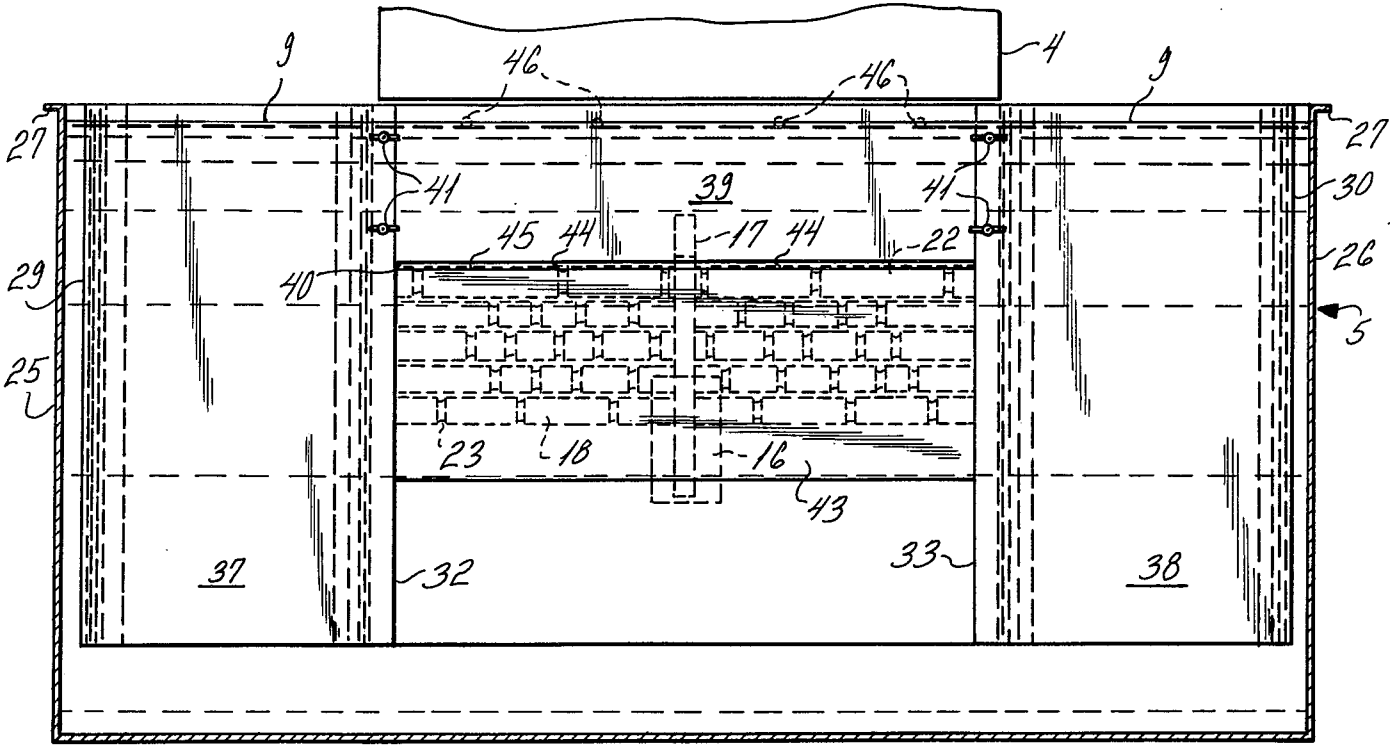
FIG. 3 is a vertical sectional view on the line III—III of FIG. 2.
Figure 5:
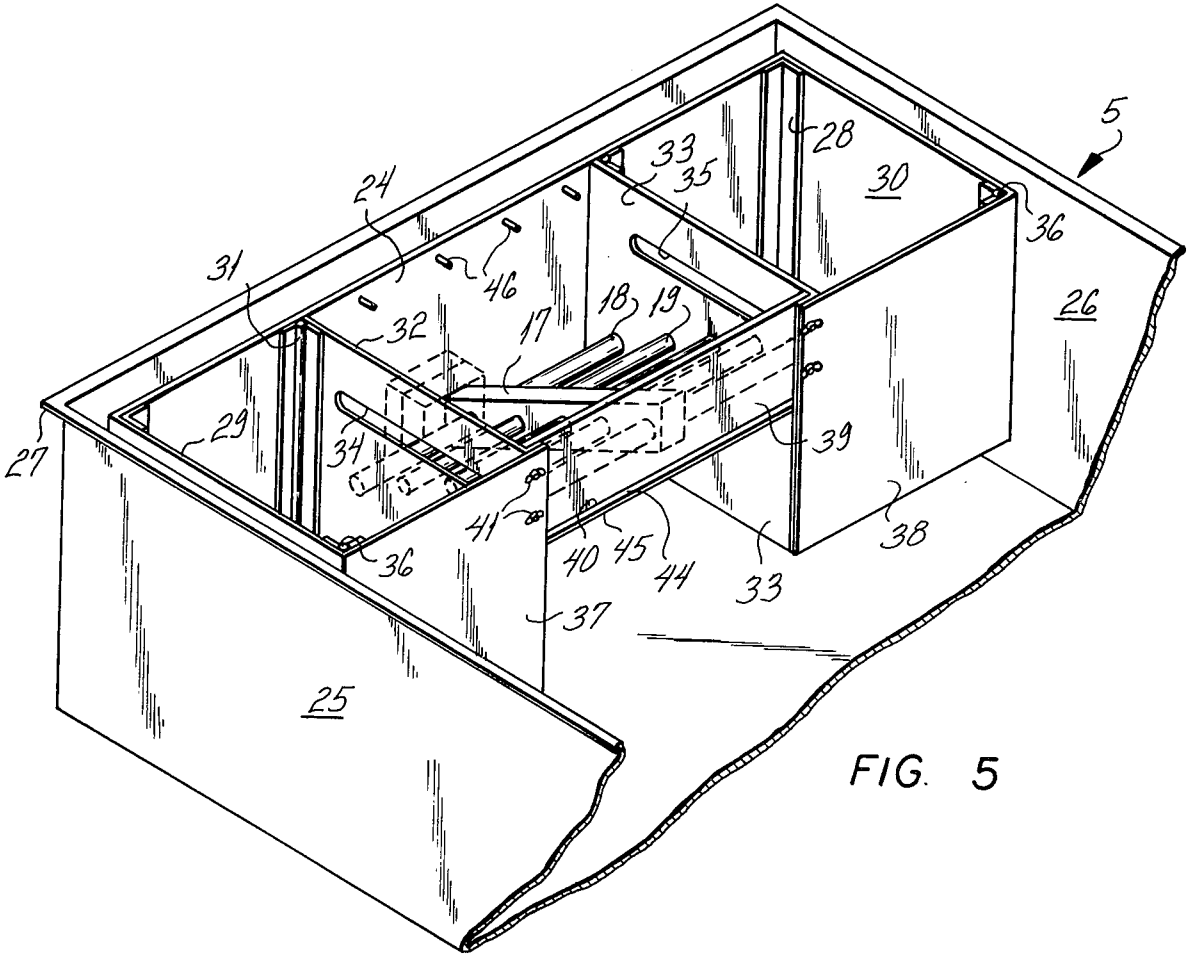
FIG. 5 is a diagrammatic isometric view of the baffle arrangement shown in FIGS. 2, 3 and 4.

The preferred embodiment of the baffle arrangement, according to the invention, to be installed in the quench tank 5, will now be described in relation to FIGS. 2 through 5. It should be noted that the relationship of the spin block 4 to the top of the quench tank 5 is shown in FIGS. 3 and 4 but has been omitted from FIG. 5 for clarity. The term 'back' in relation to the quench tank 5 means the end adjacent the spin block 4 and nearest to the extruder 1.

To a support block 14, mounted on the back wall 15 of the tank 5, is secured a flange 16 of an arm 17 to which are attached at their mid-points five guide bars 18, 19, 20, 21 and 22. Each guide bar carries a number of ceramic yarn guides 23, the disposition of which vary from guide bar to guide bar, as shown in FIGS. 2 and 3, but with each guide bar having a mirror image arrangement on each side of the arm 17. As can be seen in FIG. 4, the arm 17 extends upwards in the tank 5 at an angle of about 30 degrees to the horizontal.

A back partition 24 of the baffle arrangement is mounted on and supported by the front surface of the flange 16, and fits closely around the arm 17. The partition 24 extends across the tank 5 parallel to the tank's back wall 15, and stops short of the tank's side walls 25 and 26 by a distance a little less than by which the partition 24 is displaced by the block 14 and flange 16 from the tank's back wall 15. In the vertical direction the partition 24 extends upwards to the same level as a flange 27 around the top of the tank 5, and downwards to within a few inches of the bottom of the tank 5. At the outer edges of the partition 24 are ridgidly attached by angle brackets 28 two outer partitions 29 and 30. Pivotally attached to the partition 24 by hinges 31 are two side partitions 32 and 33 having therein quench liquid inlet apertures 34 and 35, respectively. As can be seen in FIG. 4, these apertures 34, 35 are a short distance below the water level 9. Pivotally attached by hinges 36 to the front edges of the outer partitions 29, 30 are outer front partitions 37, 38, respectively. The partitions 29, 30, 32, 33, 37 and 38 are all the same height as the back partition 24. A front partition 39, relatively short in height, is rigidly attached to the upper end of the arm 17. The upper edge of the partition 39 is at the same level as the flange 27, but the lower edge 40 of the partition 39 stops just above the lower edge of the upper end of the arm 17. The pivotal partitions 32 and 37 are detachable connected to the front partition 39 by two bolts having wing nuts 41. To accomplish this, the front edge of the side partition 32 has a flange 42 with appropriate bolt slots. The pivotal partitions 33 and 38 are similarly detachably connected to the front partition 39. A bottom partition 43 is rigidly attached to the underside of the arm 17 with its back lower edge secured the back partition 24, and its side edges abutting the side partitions 32 and 33. The narrow gap 44 between the lower edge 40 of the front partition 39 and the upper front edge 45 of the bottom partition 43 constitutes a quench liquid outlet aperture, that is said quench liquid outlet means.

The sum of the areas of the two inlet apertures 34 and 35 is greater than the area of the outlet aperture 44. In the specific embodiment the inlet apertures 34, 35 were each 10 inches long by $\frac{1}{2}$ inch high, giving a total quench liquid inlet area of 10 square inches. Whereas the outlet aperture 44 was 24 inches long by $\frac{1}{4}$ inch high giving a total quench liquid outlet area of 6 square inches.

Four wetting agent nozzles 46 are supported by the back partition 24 between the side partitions 32, 33 and at the quench water level 9.

In operation bundles of molten filaments are extruded downwardly through each spinnerette into the portion of the quench tank de-limited by the back partition 24, side partitions 32, 33, front partition 39 and bottom partition 43. The filaments are quenched and solidified in the quench water before each bundle of filaments passes around the appropriate guide 23, after which the bundles are withdrawn from said portion through the outlet aperture 44. They then are withdrawn upwards through the quench water in the remainder of the tank 5. As the bundles pass through the outlet aperture 44 they are substantially in a plane which is at an angle of about 30 degrees to the horizontal and is parallel to the bottom partition 43. Wetting agent is pumped into said portion at the surface of the quench water through the four nozzles 46. The open-topped box-like structure defined by the partitions 24, 32, 33, 39 and 43 of the baffle arrangement forms a pump body, and the action of the filaments passing through this pump body creates a pumping action with quench water entering through the inlet apertures 34, 35 and exiting through the outlet aperture 44. The area of the outlet aperture 44 is restricted (or choked) being smaller than the sum of the areas of the inlet apertures 34, 35. It will be observed that quench water from the remainder of the tank first enters the open bottoms of the side compartments formed by the partitions 29, 37, 32, 24 and 30, 38, 33, 24 before passing through the inlet apertures 34 and 35, respectively.

With this arrangement the surface of the quench liquid where the filaments enter remains relatively calm, with a substantial reduction in turbulence and vortexing. Furthermore, there is virtually no perceptible variation in the level of the quench liquid in this location, that is the hot stretch remains constant. A further advantage is that the amount of wetting agent introduced in this location can be reduced without adversely affecting the calm condition of the surface and without creating fused filaments.

When spinning is to be started up, the four wing nuts 41 are removed and the outer front partitions 37 and 38 are pivotted outwards about their hinges 36 until they lie alongside the side walls 25, 26, respectively, of the tank 5. The side partitions 32 and 33 are then pivotted outwards about their hinges 31 until they contact the outer partitions 29, 30, respectively. This allows both visual and manual access by an operator to the guide bars 18 through 22 from the sides of the tank 5, so enabling the operator to separate the filaments into their correct bundles and locate these around the appropriate guides 23. When this separation operation has been completed, the partitions 32, 33, 27 and 38 are pivotted back to the positions shown in the drawings and secured there by the wing nuts 41.

In one example each spinnerette had 16 groups of holes with 54 holes in each group. Polypropylene having a melt flow of 30 and a narrow molecular weight distribution with a swell value of 1.9, mixed with color concentrate, was extruded at a rate of 215 pounds per hour at a temperature of 435 degrees F. to produce 32 yarns each having an undrawn denier of 2,100 and 54 filaments. This yarn was subsequently drawn at a draw ratio of 3.3:1 to a drawn denier of 640, so that the denier per filament was 12.

In another example each spinnerette had 20 groups of holes with 18 holes in each group. The same material was extruded at 435 degrees F. at a rate of 250 pounds per hour to produce yarns having an undrawn denier of 1,700 and 18 filaments. The undrawn yarns were withdrawn from the quench tank at a linear speed greater than 200 meters per minute. This yarn was subsequently drawn at a draw ratio of 3.3:1 to a drawn denier of 520, the denier per filament being 29.

With both the above examples, wetting agent was introduced through each of the four nozzles 46 at a rate of 50 cubic centimetres per hours, that is 200 cc per hour for the whole quench tank. The wetting agent was a solution formed with six parts of water to one part of neat anion type wetting agent.

What is claimed is:

1. A method of producing a multifilament yarn from thermoplastic material by liquid quench melt spinning in which the filaments are extruded in molten state downwards into a quench bath containing quench liquid in which they are quenched and solidified, and in which the solidified filaments pass around guide means before being withdrawn upwardly out of said quench bath, whereby the molten filaments first enter a partitioned portion of the quench bath, the quench liquid in said partitioned portion being separated from the quench liquid in the remainder of the quench bath and only being in communication therewith through inlet means and outlet means, quench liquid entering said partitioned portion from the remainder of the quench bath through said inlet means, quench liquid exiting from said partitioned portion together with said solidified filaments through said outlet means into the remainder of the quench bath, said filaments passing around said guide means before so exiting, the movement of the filaments through said partitioned portion generating a pumping action of the quench liquid therethrough, and said pumping action being caused to be inefficient by the area of said inlet means being greater than the area of said outlet means with a substantial reduction of vortexing where the filaments first enter the quench liquid.

2. A method as claimed in claim 1 in which said quench liquid enters said partitioned portion at a level in the quench bath above that at which it exits from said partitioned portion.

3. A method as claimed in claim 2 in which below said partitioned portion is quench liquid in the remainder of the quench bath.

4. A method as claimed in claim 3 in which said quench liquid enters said partitioned portion transversely to the direction in which it exits therefrom.

5. A method as claimed in claim 4 in which said partitioned portion is surrounded on all sides by quench liquid in the remainder of the quench bath.

6. A method as claimed in claim 1 in which said thermoplastic material is polypropylene having a narrow molecular weight distribution, and said yarn has at least 27 filaments each of which has a denier after drawing of less than 25.

* * * * *